US010250014B2

(12) United States Patent
Kobayashi

(10) Patent No.: US 10,250,014 B2
(45) Date of Patent: Apr. 2, 2019

(54) SPARK PLUG

(71) Applicant: NGK SPARK PLUG CO., LTD., Nagoya-shi, Aichi (JP)

(72) Inventor: Tsutomu Kobayashi, Inazawa (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 15/780,430

(22) PCT Filed: Nov. 11, 2016

(86) PCT No.: PCT/JP2016/083482
§ 371 (c)(1),
(2) Date: May 31, 2018

(87) PCT Pub. No.: WO2017/141506
PCT Pub. Date: Aug. 24, 2017

(65) Prior Publication Data

US 2018/0351332 A1 Dec. 6, 2018

(30) Foreign Application Priority Data

Feb. 16, 2016 (JP) ..... 2016-027309

(51) Int. Cl.
*H01T 13/20* (2006.01)
*H01T 13/34* (2006.01)

(52) U.S. Cl.
CPC ..... *H01T 13/34* (2013.01)

(58) Field of Classification Search
CPC ..... H01T 13/34; H01T 13/20; H01T 13/04; H01T 13/32; H01T 21/02; H01T 13/41; H01T 13/05; H01T 13/639; H01R 13/639; H01R 13/46; H01B 17/26
USPC ..... 174/152 S, 137; 313/144, 118, 137, 145, 313/141
See application file for complete search history.

(56) References Cited

U.S. PATENT DOCUMENTS 4,004,183 A * 1/1977 Oki ..... H01T 13/41 174/152 S
7,626,320 B2 * 12/2009 Shibata ..... H01T 13/34 313/144
7,825,572 B2 * 11/2010 Nakayama ..... H01T 13/32 313/143
9,419,415 B2 * 8/2016 Mizuno ..... H01T 13/41
9,843,166 B2 * 12/2017 Okazaki ..... H01T 13/20
(Continued)

FOREIGN PATENT DOCUMENTS

JP 2015-064987 A 4/2015

*Primary Examiner* — Angel R Estrada
(74) *Attorney, Agent, or Firm* — Kusner and Jaffe

(57) ABSTRACT

Disclosed is a spark plug capable of preventing electrode wear while ensuring impact resistance. In the spark plug, a conductive seal is arranged between a rear end portion of a center electrode and a resistor within an axial hole of an insulator. The conductive seal includes a side-surface seal layer brought into contact with the whole of a side surface of the rear end portion of the center electrode and having a thickness of 10 μm or larger in an axis perpendicular direction. Assuming that a projection area is defined by projecting the center electrode onto the axial hole in the axis perpendicular direction around a center axis of the spark plug, a contact surface of the resistor brought into contact with the axial hole overlaps at last a part of the projection area.

5 Claims, 8 Drawing Sheets

(56) References Cited

U.S. PATENT DOCUMENTS

| | | | | |
|---|---|---|---|---|
| 9,997,894 | B2 * | 6/2018 | Uegaki | H01T 13/34 |
| 10,014,665 | B2 * | 7/2018 | Kita | H01T 13/04 |
| 10,027,093 | B2 * | 7/2018 | Kobayashi | H01T 13/20 |
| 10,033,163 | B1 * | 7/2018 | Sumoyama | H01T 13/39 |
| 10,079,476 | B2 * | 9/2018 | Kato | H01T 13/20 |
| 10,090,646 | B2 * | 10/2018 | Takaoka | H01T 13/05 |

* cited by examiner

SPARK PLUG

RELATED APPLICATIONS

This application is a National Stage of International Application No. PCT/JP16/83482 filed Nov. 11, 2016, which claims the benefit of Japanese Patent Application No. 2016-027309 filed Feb. 16, 2016, the entire contents of which are incorporated herein by reference.

FIELD OF THE INVENTION

The present invention relates to a spark plug with a built-in resistor and, more particularly, to a spark plug capable of preventing electrode wear.

BACKGROUND OF THE INVENTION

A spark plug is known having a built-in resistor to suppress radio noise generated by spark discharge (see, for example, Japanese Laid-Open Patent Publication No. 2015-64987). This type of spark plug includes: an insulator formed with an axial hole in which the resistor is arranged; a metal shell partially surrounding an outer circumferential surface of the insulator; a ground electrode joined to a front end of the metal shell; a center electrode inserted in the axial hole of the insulator; and a conductive seal held in contact with the center electrode and the resistor. There is a spark gap defined between a front end of the center electrode and the ground electrode so that a flame kernel is produced in the spark gap at the time of spark discharge.

The above conventional spark plug has the problem that, at the time of spark discharge, electric charge accumulated in a parasitic capacitance between the metal shell and the conductive seal or the center electrode moves to the spark gap and accelerates wear of the center electrode and the ground electrode (generically referred to as "electrode wear").

In order to decrease the amount of the electric charge that accelerates electrode wear, it is conceivable to reduce the parasitic capacitance by decreasing the area of the conductive seal. However, this leads to a decrease in the contact area between the conductive seal and the center electrode so that the state of contact between the conductive seal and the center electrode becomes deteriorated by impact or vibration (that is, the spark plug becomes deteriorated in impact resistance).

The present invention has been made to address the above problems. An advantage of the present invention is a spark plug capable of preventing electrode wear while ensuring impact resistance.

SUMMARY OF THE INVENTION

In accordance with a first aspect of the present invention, there is provided a spark plug, comprising: a cylindrical metal shell having a front end to which a ground electrode is joined; an insulator having an outer circumferential surface partially surrounded by the metal shell and being formed with an axial hole, the axial hole including a first hole portion and a second hole portion larger in inner diameter than the first hole portion and continuous to the first hole portion via a step portion; a center electrode having a rear end portion disposed on the step portion of the insulator and a leg portion extending from the rear end portion toward the ground electrode in an axis direction; a metal terminal having a front end portion disposed in the second hole portion with a space left between the front end portion of the metal terminal and the rear end portion of the center electrode; a resistor arranged between the front end portion of the metal terminal and the rear end portion of the center electrode within the second hole portion; and a conductive seal brought into contact with the resistor and the rear end portion of the center electrode. The conductive seal includes a side-surface seal layer being contact with the whole of a side surface of the rear end portion of the center electrode and having a thickness of 10 μm or larger in a direction perpendicular to the axis direction. As the contact area between the side surface of the rear end portion of the center electrode and the conductive seal is prevented from becoming small, the spark plug ensures impact resistance.

Assuming that a projection area is defined by projecting the center electrode onto the axial hole in the direction perpendicular to the axis direction around a center axis of the spark plug, a contact surface of the resistor brought into contact with the axial hole overlaps at least a part of the projection area. In this configuration, electric charge accumulated in a parasitic capacitance between the conductive seal and the metal shell moves from the overlap of the contact surface and the projection area to the center electrode at the time when spark discharge occurs between the center electrode and the ground electrode. When the electric charge moves in the overlap of the contact surface and the projection area, there occurs a voltage drop by means of the resistor which is in contact with the overlap. The energy of the electric charge can be reduced by an amount corresponding to the voltage drop. As a result, it becomes less likely that wear of the center electrode and the ground electrode will occur. Namely, the spark plug has the effect of preventing electrode wear while ensuring impact resistance.

In accordance with a second aspect of the invention, there is provided a spark plug as described above, wherein the thickness of the side-surface seal layer is 100 μm or smaller. In this case, the volume of the side-surface seal layer is ensured. Thus, the spark plug has the effect of ensuring the bonding strength between the rear end portion of the center electrode and the conductive seal in addition to the effect of the invention described above.

In accordance with a third aspect of the invention, there is provided a spark plug as described above, wherein the overlap of the contact surface and the projection area is continuous in an annular shape on the axial hole. In this case, the probability that the electric charge moves through the overlap of the contact surface and the projection area at the time of spark discharge is increased. Thus, the spark plug has the effect of more reliably preventing electrode wear in addition to the effect of the invention described above.

In accordance with a fourth aspect of the invention, there is provided a spark plug as described above, wherein the overlap of the contact surface and the projection area is located on at least a part of the step portion. In this case, the length of the overlap of the contact surface and the projection area in the axis direction is increased as the rear end portion of the center electrode is disposed on the step portion which is formed at a boundary between the first hole portion and the second hole portion. As a consequent, the probability that the electric charge moves through the overlap of the contact surface and the projection area at the time of spark discharge is increased. The spark plug thus has the effect of more reliably preventing electrode wear in addition to the effect of the invention described above.

In accordance with a fifth aspect the invention of claim 5, there is provided a spark plug as described above, wherein the conductive seal includes an end-surface seal layer being contact with the whole of a rear end surface of the rear end portion and having a thickness of 10 μm or larger in the axis direction. In this case, the contact area of the resistor and the conductive seal is ensured by the end-surface seal layer. Thus, the spark plug has the effect of preventing variations in resistance in addition to the effect of the invention described above.

DETAILED DESCRIPTION OF THE INVENTION

Hereinafter, preferred embodiments of the present invention will be described below with reference to the drawings.

Figure 1:
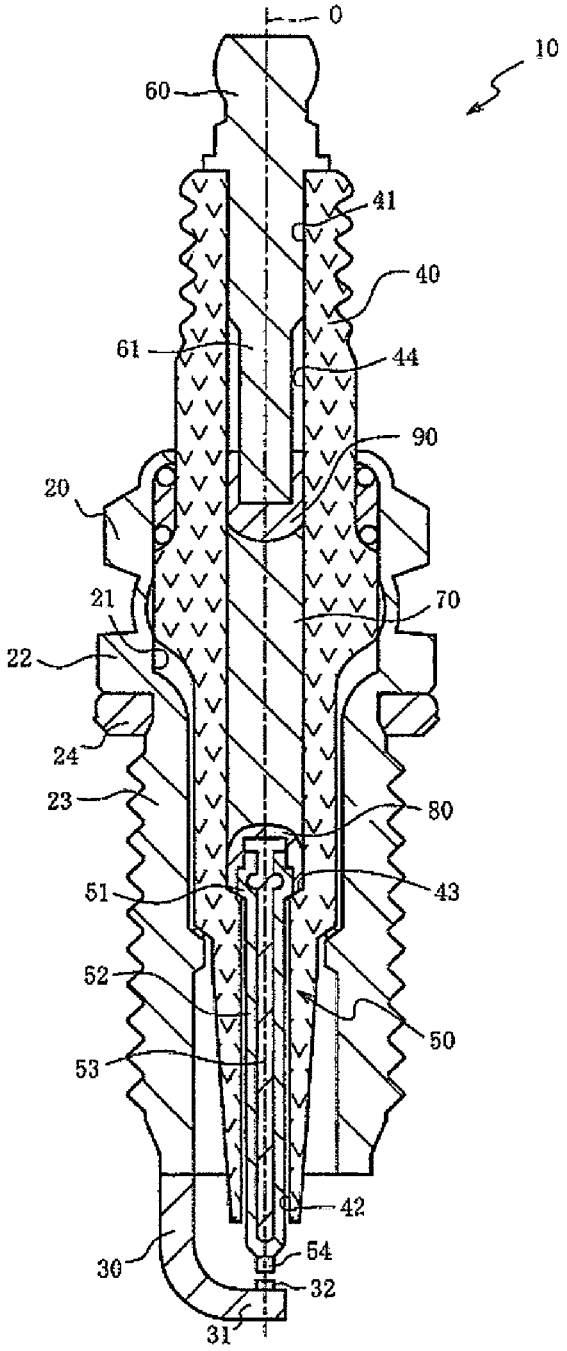
FIG. 1 is a cross-sectional view of a spark plug according to a first embodiment of the present invention.

FIG. 1 is a cross-sectional view of a spark plug 10 according to the first embodiment of the present invention, as taken along a plane including a center axis O of the spark plug. In the following description, the lower and upper sides of FIG. 1 are referred to as front and rear sides of the spark plug 10, respectively. (The same applies to FIGS. 2 to 8.) As shown in FIG. 1, the spark plug 10 includes a metal shell 20, a ground electrode 30, an insulator 40, a center electrode 50, a metal terminal 60 and a resistor 70.

The metal shell 20 is a substantially cylindrical member fixed into a screw hole (not shown) of an internal combustion engine. A through hole 21 is made through the metal shell 20 along the center axis O. The metal shell 20 is formed of a conductive metal material (such as low carbon steel), and includes: a seat portion 22 radially outwardly protruding in a collar shape; and a thread portion 23 formed on an outer circumferential surface of the metal shell 20 at a location frontward of the seat portion 22. An annular gasket 24 is fitted between the seat portion 22 and the thread portion 23 so as to, when the thread portion 23 is screwed into the screw hole of the internal combustion engine, seal a clearance between the metal shell 20 and the internal combustion engine (engine head).

The ground electrode 30 is a member formed of a metal material (such as nickel-based alloy) and joined to a front end of the metal shell 20. In the first embodiment, the ground electrode 30 is rod-shaped and is bent such that a distal end portion 31 of the ground electrode 30 is directed to and intersects the center axis O. An electrode tip 32 of platinum or platinum-based alloy is joined to the distal end portion 31 at a position intersecting the center axis O.

The insulator 40 is a substantially cylindrical member formed of alumina etc. having good mechanical properties and high-temperature insulating properties. An axial hole 41 is made through the insulator 40 along the center axis O. The insulator 40 is inserted in the through hole 21 of the metal shell 20; and the metal shell 20 is fixed to an outer circumference of the insulator 40. Front end rear ends of the insulator 40 are respectively exposed from the through hole 21 of the metal shell 20.

The axial hole 41 includes: a first hole portion 42 of circular cross section located at a front end side of the insulator 40; a step portion 43 connected to a rear end of the first hole portion 42 and extending radially outwardly; and a second hole portion 44 of circular cross section located at a rear end side of the insulator 40 and connected to an outer edge of the step portion 43. An inner diameter of the second hole portion 44 is made larger than an inner diameter of the first hole portion 42.

The center electrode 50 is a rod-shaped member that extends along the center axis O and includes: a rear end portion 51 disposed on the step portion 43 of the axial hole 41; and a leg portion 52 extending from the rear end portion 51 along the center axis O. The center electrode 50 has embedded therein a core 53. In the first embodiment, the core 53 is formed of copper or copper-based alloy and covered with the base material such as nickel or nickel-based alloy of the center electrode 50. A major part of the leg portion 52 is situated in the first hole portion 42, whereas a front end of the leg portion 52 is exposed from the first hole portion 42 and is opposed to the ground electrode 30 so as to define a spark gap therebetween. An electrode tip 53 of iridium or iridium-based alloy is joined to the front end of the leg portion 52.

The metal terminal 60 is a rod-shaped member to which a high-voltage cable (not shown) is connected, and is formed of a conductive metal material (such as low carbon steel). The metal terminal 60 is press-fitted in the axial hole 41 of the insulator 40, with a front end portion 61 of the metal terminal 60 situated in the second hole portion 44.

The resistor 70 is arranged between the front end portion 61 of the metal terminal 60 and the rear end portion 51 of the center electrode 50 in the second hole portion 44 so as to suppress radio noise generated by spark discharge. The resistor 70 is formed of a composition containing glass particles as a main component, particles of ceramic other than glass and a conductive material. As the material of the glass particles, there can be used $B_2O_3$—$SiO_2$ glass, BaO—$B_2O_3$ glass, $SiO_2$—$B_2O_3$—CaO—BaO glass or the like. As the material of the ceramic particles, there can be used $TiO_2$, $ZrO_2$ or the like. As the conductive material, there can be used a non-metallic material such as carbon particles (e.g. carbon black), TiC particles or TiN carbon particles or a metal material such as Al, Mg, Ti, Zr or Zn. The resistance value of the resistor 70 is preferably in the range of e.g. 1 kΩ to 30 kΩ, more preferably 1 kΩ to 20 kΩ.

Conductive seals 80 and 90 are respectively disposed between the resistor 70 and the center electrode 50 and between the resistor 70 and the metal terminal 60. The conductive seal 80 is in contact with the resistor 70 and the center electrode 50, whereas the conductive seal 90 is in contact with the resistor 70 and the metal terminal 60. The center electrode 50 and the metal terminal 60 are hence electrically connected to each other via the resistor 70 and the conductive seals 80 and 90. Each of the conductive seals 80 and 90 is formed of a composition containing particles of glass mentioned above and particles of metal (such as Cu or Fe) at a ratio of about 1:1. The specific resistance of the conductive seal 80, 90 is in the range between the specific resistance of the center electrode 50 or the metal terminal 60 and the specific resistance of the resistor 70. Thus, the contact resistance of the conductive seal with the center electrode 50, the metal terminal 60 the resistor 70 is stabilized so as to secure the stable resistance value between the center electrode 50 and the metal terminal 60.

Figure 2:
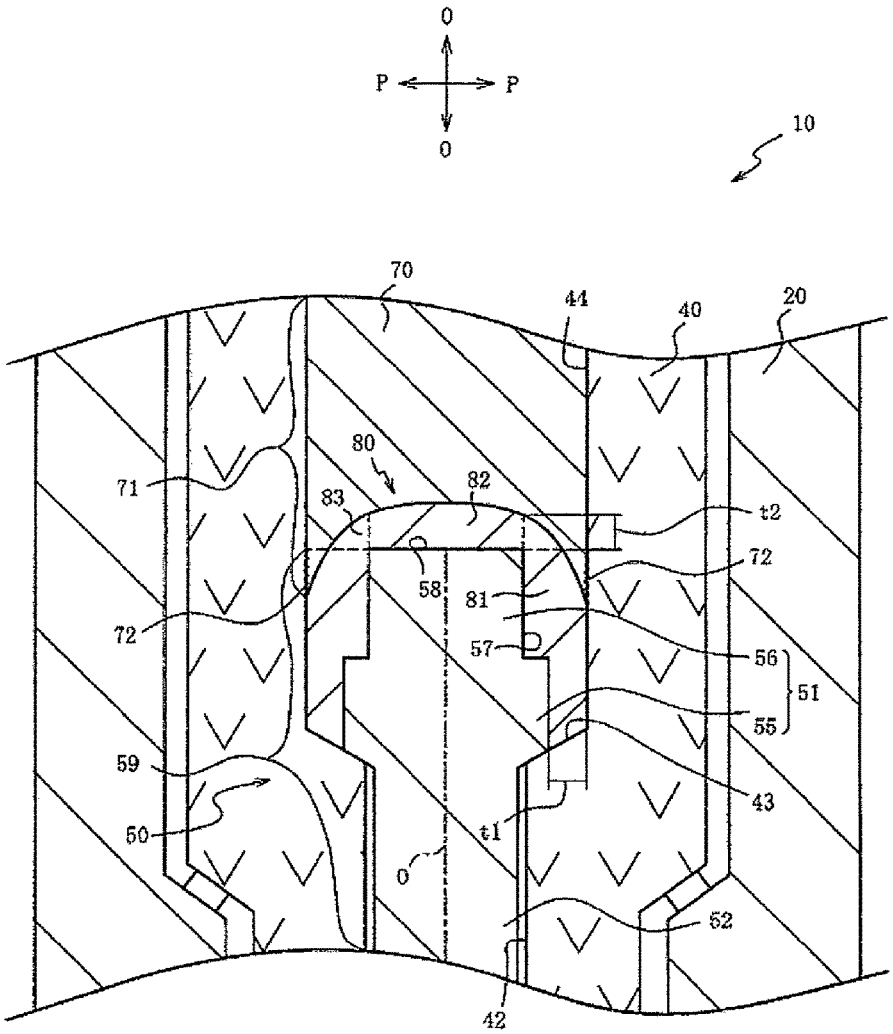
FIG. 2 is an enlarged cross-sectional view of a part of the spark plug.

The relationship of the resistor 70, the conductive seal 80 and the center electrode 50 will be explained below with reference to FIG. 2. FIG. 2 is an enlarged cross-sectional view of a part of the spark plug 10 (in the vicinity of the rear end portion 51 of the center electrode 50) (as taken through the center axis O). (The same applies to FIGS. 3 to 8.) In FIG. 2, an arrow O indicates an axis direction of the spark plug 10; and an arrow P indicates an axis perpendicular direction perpendicular to the axis direction. In FIG. 2, some portions of the center electrode 50 and the resistor 70 in the axis direction, the core 53 of the center electrode 50, the thread portion 23 of the metal shell 20 are omitted from illustration for ease of understanding.

As shown in FIG. 2, the rear end portion 51 of the center electrode 50 includes: a collar section 55 larger in outer diameter than the leg portion 52; and a head section 56 protruding from the collar section 55 to a side opposite the leg portion 52 (i.e. in the arrow O direction). Each of the collar section 55 and the head section 56 has a cylindrical column shape whose center coincides with the center axis O. The head section 56 is made smaller in outer diameter than the collar section 55. As the outer diameter of the collar section 55 is made larger than the inner diameter of the first hole portion 42, the rear end portion 51 is disposed on the step portion 43 and situated in the second hole portion 44. Side surfaces of the collar section 55 and the head section 56 constitute a side surface 57 of the rear end portion 51 in the axis perpendicular direction (i.e. the arrow P direction). A rear end surface of the head section 56 in the axis direction constitutes a rear end surface 58 of the rear end portion 51 in the axis direction.

The resistor 70 has a contact surface 71 brought into contact with the second hole portion 44 of the insulator 40. The contact surface 71 is, on the second hole portion 44, continuous in an annular shape whose center coincides with the center axis C. It is herein assumed that a projection area 59 is defined by projecting the center electrode 50 onto the second hole portion 44 in the axis perpendicular direction around the center axis O. The projection area 59 and the contact surface 71 overlap each other at an overlap region 72 on a front end side (lower side in FIG. 2) of the resistor 70. The overlap region 72 includes an edge of the projection area 59 in the circumferential direction and extends in a continuous annular shape on the second hole portion 44. The contact surface 71 and the projection area 59 are continuous in the axis direction within the range of existence of the resistor 70 and the center electrode 50. As some portions of the resistor 70 and the center electrode 50 in the axis direction are omitted from illustration in FIG. 2, there are shown the contact surface 71 and the projection area 59 in the illustrated range of the resistor 70 and the center electrode 50. (The same applies to FIGS. 3 to 8.)

The conductive seal 80 is arranged between the rear end portion 51, which is disposed on the step portion 43, and the resistor 70. In the first embodiment, the conductive seal 80 includes: a side-surface seal layer 81 brought into contact with the whole side surface 57 of the rear end portion 51; an end-surface seal layer 82 brought into contact with the whole rear end surface 58 of the rear end portion 51; and an annular seal layer 83 located between the end-surface seal layer 82 and the side-surface seal layer 81.

The side-surface seal layer 81 is in contact with the whole side surface 57 of the rear end portion 51, the second hole portion 44, the step portion 43 and the resistor 70. When viewed in the axis direction, the side-surface seal layer 81 is cylindrical in shape. The thinnest part of the side-surface seal layer 81, which has the smallest thickness t1 in the axis perpendicular direction, is formed between the collar section 55 and the second hole portion 44. The thickness t1 is preferably 10 μm or larger, more preferably 100 μm or larger.

The end-surface seal layer 82 is in contact with the rear end face 58 of the rear end portion 51 and the resistor 70. When viewed in the axis direction, the end-surface seal layer 82 is circular in shape. The annular seal layer 83 is in contact with the end-surface seal layer 82, the side-surface seal layer 81 and the resistor 70. When viewed in the axis direction, the annular seal layer 83 is ring-shaped. The thinnest part of the end-surface seal layer 82, which has the smallest thickness t2 in the axis direction, is formed at a boundary between the end-surface seal layer 82 and the annular seal layer 83. The thickness t2 is preferably 10 μm or larger, more preferably 100 μm or larger.

For example, the spark plug 10 can be manufactured by the following method. The center electrode 50 is first inserted from into the second hole portion 44 of the insulator 40. The rear end portion 51 of the center electrode 50 is supported on the step portion 43 and situated in the second hole portion 44, with the leg portion 52 hanging in the first hole portion 42.

The raw material powder of the conductive seal 80 is then filled into a space around the rear end portion 51 within the second hole portion 44. Herein, provided is a compression rod member (not shown) having a concave end surface curved inwards in the middle. The raw material powder of the conductive seal 80 filled in the second end hole 44 is subjected to pre-compression molding by this compression rod member. Consequently, the raw material powder of the conductive seal 80 is molded into a convex shape corresponding to the concave shape of the end surface of the compression rod member. The length of the overlap region 72 in the axis direction and the continuity of the overlap region 72 in the circumferential direction are set according to the depth of the concave in the end surface of the compression rod member, the pre-compression molding pressure applied by the compression rod member and the like.

The raw material powder of the resistor 70 is filled in a space above the molded raw material powder of the conductive seal 80 within the second hole portion 44 and subjected to pre-compression molding by another compression rod member (not shown). After that, the raw material powder of the conductive seal 90 is filled into a space above the raw material powder of the resistor 70 within the second hole portion 44 and subjected to pre-compression molding by the compression rod member (not shown).

The insulator 40 in which the raw material powders of the conductive seal 80, the resistor 70 and the conductive seal 90 have been put in order is moved into a furnace and then heated to e.g. a temperature higher than the softening points of the glass components contained in the respective raw material powders. After the heating, the metal terminal 60 is press-fitted in the second hole portion 44 of the insulator 40 so as to compress the raw material powders of the conductive seal 80, the resistor 70 and the conductive seal 90 in the axis direction by the front end portion 61 of the metal terminal 60. As a consequence, the respective raw material powders are compressed and sintered. There are thus formed the conductive seal 80, the resistor 70 and the conductive seal 90 inside the insulator 40.

Subsequently, the insulator 40 is taken out of the furnace. The metal shell 20 is fixed to the outer circumference of the insulator 40. The ground electrode 30 is joined to the metal shell 20. The electrode tip 32 is welded to the distal end portion 31 of the ground electrode 30. The ground electrode 30 is bent such that the distal end portion 31 of the ground electrode 30 is opposed to the center electrode 50 in the axis direction. In this way, the spark plug 10 is obtained.

The spark plug 10 develops a parasitic capacitance between the center electrode 50, the conductive seal 80 and the metal shell 20. This parasitic capacitance is a result of the insulator 40 (dielectric material) and the air layer (dielectric material) between the metal shell 20 and the insulator 40 being interposed by the center electrode 50, the conductive seal 80 and the metal shell 20. With the application of a high voltage between the metal terminal 60 and the metal shell 20, electric charge is accumulated in the parasitic capacitance. The spark plug presents the problem that, at the time of spark discharge, the accumulated electric charge moves to the center electrode 50 and accelerates wear of the center electrode 50 and the ground electrode 30 (electrode wear).

Among the electric charge accumulated in the parasitic capacitance, the electric charge accumulated between the resistor 70 and the metal shell 20 moves from the resistor 70 to the center electrode 50 through the conductive seal 80 at the time of spark discharge. There occurs a voltage drop with the passage of the electric charge through the resistor 70. As the energy of the electric charge can be reduced by an amount corresponding to the voltage drop, it is possible to prevent the occurrence of electrode wear. Namely, reduction of the parasitic capacitance in the region frontward of the resistor 70, i.e., between the conductive seal 80, the center electrode 50 and the metal shell 20 is effective to prevent the occurrence of electrode wear due to the parasitic capacitance.

As a method for reducing the parasitic capacitance developed between the conductive seal 80, the center electrode 50 and the metal shell 20, it is conceivable to decrease the area of the conductive seal 80 (more specifically, the length of the conductive seal 80 in the axis direction) or to decrease the inner diameter of the second hole portion 44 (that is, increase the thickness of the insulator 40 in the axis perpendicular direction). In the case of decreasing the area of the conductive seal 80 on the side surface 57 of the rear end portion 51, there arises a problem that the contact of the conductive seal 80 and the center electrode 50 may become unstable by impact or vibration (the spark plug becomes deteriorated in impact resistance) due to a decrease in the contact area between the conductive seal 80 and the center electrode 50 (rear end portion 51). In the case of decreasing the area of the conductive seal 80 on the end surface 58 of the rear end portion 51, there arises a possibility of variations in resistance due to a contact of the center electrode 50 (rear end portion 51) and the resistor 70. In the case of decreasing the inner diameter of the second hole portion 44 and thereby increasing the thickness of the insulator 40 in the axis perpendicular direction, the outer diameter of the resistor 70 decreases with decrease in the inner diameter of the second hole portion 44 so that the lifetime of the resistor 70 may be shortened.

In order to address these problems, the conductive seal 80 and the resistor 70 of the spark plug 10 are configured such that the contact surface 71 of the resistor 70 brought into contact with the second hole portion 44 and the projection area 59 defined by projecting the center electrode 50 onto the second hole portion 44 in the axis perpendicular direction around the center axis 0 overlap each other at the overlap region 72. Accordingly, at least a part of the electric charge accumulated in the parasitic capacitance between the conductive seal 80 and the metal shell 20 moves from the overlap region 72 to the center electrode 50 at the time of spark discharge. In the overlap region 72, the electric charge passes through a portion (front end) of the resistor 70. At that time, there occurs a voltage drop. The energy of the electric charge moving to the center electrode 50 can be reduced by an amount corresponding to the voltage drop. It is thus unlikely that the spark plug will cause electrode wear.

On the other hand, the side-surface seal layer 81 of the conducive seal 80 is formed with a thickness t1 of 10 μm or larger in the axis perpendicular direction and brought into contact with the whole side surface 57 of the rear end portion 51 of the center electrode 50 so as to prevent a decrease in the contact area between the conductive seal 80 and the rear end portion 51 of the center electrode 50. It is thus possible to ensure impact resistance. In short, the spark plug has the effect of preventing electrode wear while ensuring impact resistance.

When the thickness t1 of the side-surface seal layer 81 is 100 μm or larger, the volume of the side-surface seal layer 81 is ensured more reliably so that it is possible to secure the bonding strength between the rear end portion 51 of the center electrode 50 and the conductive seal 80.

In the spark plug 10, the overlap region 72 is continuous in an annular shape on the axial hole 41 (second hole portion 44). In this configuration, the probability that the electric charge moves through the overlap region 72 and the resistor 70 at the time of spark discharge is increased as compared to the case where the overlap region 72 is located intermittently on the edge of the projection area 59. It is thus possible to more reliably prevent electrode wear.

Further, the end-surface seal layer 82 of the conductive seal 80 is formed with a thickness t2 of 10 μm or larger and brought into contact with the whole rear end surface 58 of the rear end portion 51. As the contact area between the resistor 70 and the conductive seal 82 is ensured by the end-surface seal layer 82, it is possible to prevent variations in resistance. When the thickness t2 of the end-surface seal layer 82 is 100 μm or larger, the volume of the end-surface seal layer 80 is ensured more reliably so that it is possible to improve the contact stability between the end-surface seal layer 82 and the resistor 70.

It is not an essential condition that the overlap region 72 has a continuous annular shape including the entire edge of the projection area 59. In the present invention, it is enough that the overlap region 72 includes at least a part of the edge of the projection area 59. When the overlap region 72 is present, even slightly, a part of the electric charge accumulated in the parasitic capacitance between the conductive seal 80 and the metal shell 20 moves in the resistor 70 and the overlap region 72 so that the energy of the electric charge can be reduced as compared to the case where the overlap region 72 is not present.

In the case where the overlap region 72 includes at least a part of the edge of the projection area 59, the length of the overlap region 72 on the edge of the projection area 59 is preferably longer than or equal to ¼, more preferably longer than or equal to ⅓, still more preferably longer than or equal to ½, yet more preferably longer than or equal to ⅔, of the entire length of the edge of the projection area 59. The longer the length, the larger the area of the overlap region 72, the more increased the probability that the electric charge moves through the overlap region 72 and the resistor 70 at the time of spark discharge. It is thus more unlikely that electrode wear will occur.

In the case where the overlap region 72 includes a part or the whole of the edge of the projection area 59, the length of the overlap region 72 in the axis direction (i.e. the distance from a point of the overlap region closest to the step portion 43 to the edge of the projection area 59) is preferably longer than or equal to ¼, more preferably longer than or equal to ⅓, still more preferably longer than or equal to ½, yet more preferably longer than or equal to ⅔, of the length of the projection area 59 in the axis direction (i.e. the distance from a boundary of the step portion 43 and the second hole portion 44 to the edge of the projection area 59). The longer the length, the larger the area of the overlap region 72, the more increased the probability that the electric charge moves through the overlap region 72 and the resistor 70 at the time of spark discharge. It is thus more unlikely that electrode wear will occur.

Figure 3:
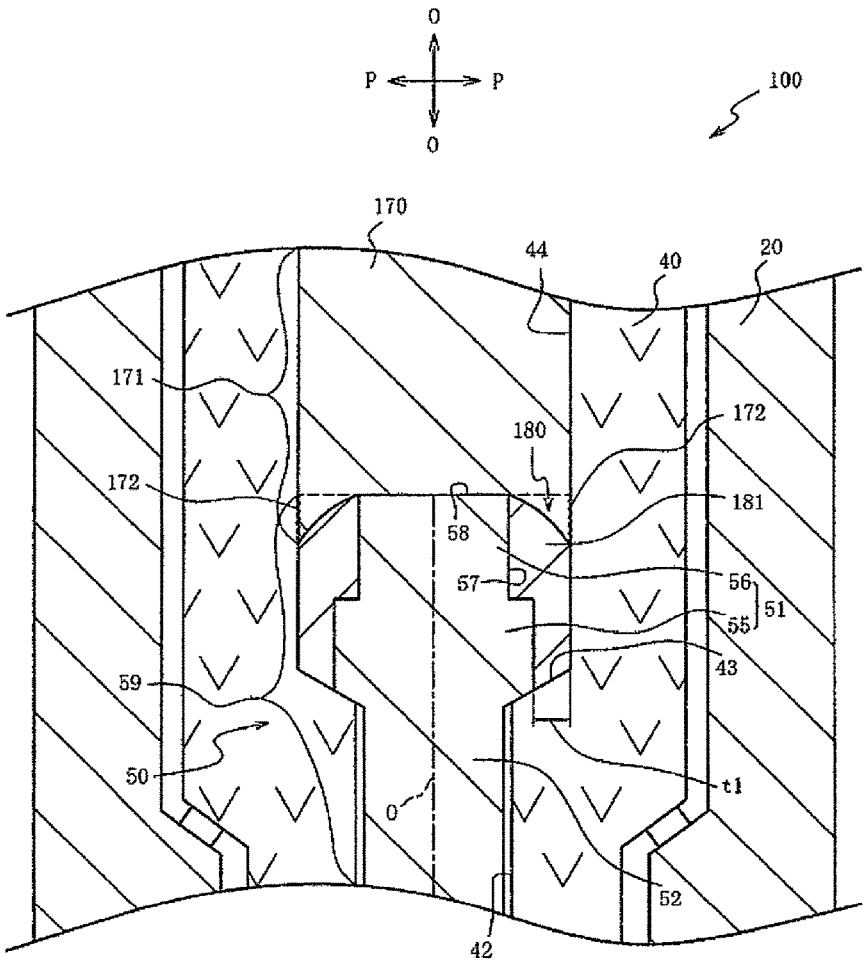
FIG. 3 is a cross-sectional view of a spark plug according to a second embodiment of the present invention.

Next, the second embodiment will be described below with reference to FIG. 3. The first embodiment refers to the case where the conductive seal 80 is formed including the end-surface seal layer 82. By contrast, the second embodiment refers to a spark plug 100 in which a conductive seal 180 is formed with no end-surface seal layer. Herein, the same parts and portions of the second embodiment as those of the first embodiment are designated by the same reference numerals; and explanations thereof will be omitted herefrom. FIG. 3 is a cross-sectional view of the spark plug 100 according to the second embodiment.

In the spark plug 100, a resistor 170 is brought into contact at a contact surface 171 thereof with the second hole portion 44 as shown in FIG. 3. The contact surface 171 is, on the second hole portion 44, continuous in an annular shape whose center coincides with the center axis O. The contact surface 171 and the projection area 59 overlap each other at an overlap region 172 on a front end side (lower side in FIG. 3) of the resistor 170. The overlap region 172 is continuous in an annular shape on the second hole portion 44.

The conductive seal 180 includes a side-surface seal layer 181 brought into contact with the whole side surface 57 of the rear end portion 51. When viewed in the axial direction, the side-surface seal layer 181 is cylindrical in shape. The thinnest part of the side-surface seal layer 181, which has the smallest thickness t1 in the axis perpendicular direction, is formed between the collar section 55 and the second hole portion 44. The thickness t1 is preferably 10 μm or larger, more preferably 100 μm or larger.

A manufacturing method of the spark plug 100 is different from the manufacturing method of the spark plug 10, in the process of filling the raw material powder of the conductive seal 180 into the front end region of the second hole portion 44 of the insulator 40 (i.e. the space around the rear end portion 51). In order to prevent adhesion of the raw material powder of the conductive seal 180 to the rear end surface 58, provided herein is a pipe (not shown) having an inner diameter slightly larger than the rear end surface 58. This pipe is inserted into the second hole portion 44; and the head section 56 (rear end surface 58) of the rear end portion 51 is inserted into the pipe. Then, the raw material powder of the conductive seal 180 is filed into a space between the outer surface of the pipe and the second hole portion 44. The raw material powder of the conductive seal 180 filled in the second hole portion 44 is subjected to pre-compression molding by inserting a compression cylindrical member (not shown), which has an end surface curved inwards along a concave curve, on the outer side of the pipe in a state of the pipe being inserted in the second hole portion 44. After the pipe and the compression cylindrical member are taken out, the raw material powder of the resistor 170 is filled and molded.

As in the case of the first embodiment, the spark plug 100 is so configured that at least a part of the electric charge accumulated in the conductive seal 180 moves to the overlap region 172 through the resistor 170 at the time of spark discharge. There occurs a voltage drop with the passage of the electric charge through the resistor 170. The energy of the electric charge can be reduced by an amount corresponding to the voltage drop. It is thus possible to prevent electrode wear. As the side-surface seal layer 181 of the conductive seal is brought into contact with the whole side surface 57 of the rear end portion 51, it is possible to ensure impact resistance. Further, it is possible to secure the contact of the conductive seal 180 and the resistor 170 as the side-surface seal layer 181 of the conductive seal 180 is brought into contact with the resistor 170.

Figure 4:
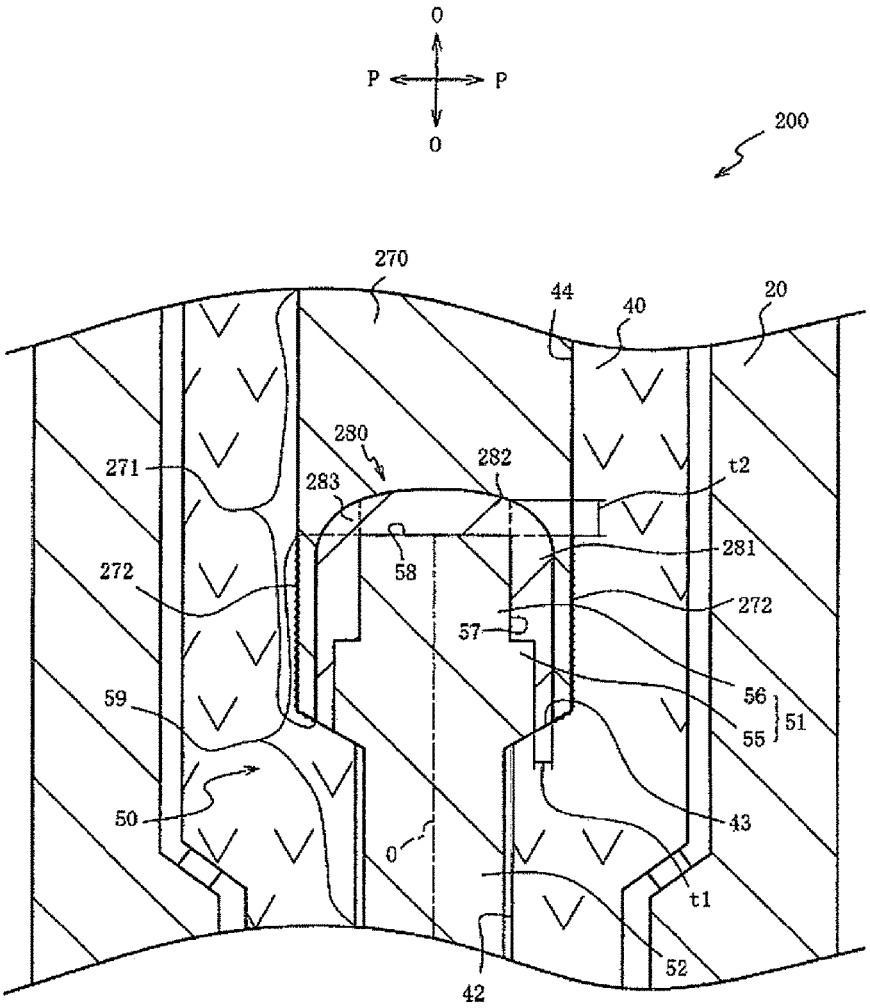
FIG. 4 is a cross-sectional view of a spark plug according to a third embodiment of the present invention.

The third embodiment will be next described below with reference to FIG. 4. The first and second embodiments refer to the case where the side-surface seal layer 81, 181 is in contact with the second hole portion 44. By contrast, the third embodiment refers to the case where a side-surface seal layer 281 of a conductive seal is not in contact with the second hole portion 44. Herein, the same parts and portions of the third embodiment as those of the first embodiment are designated by the same reference numerals; and explanations thereof will be omitted herefrom. FIG. 4 is a cross-sectional view of a spark plug 200 according to the third embodiment.

In the spark plug 200, a resistor 270 is brought into contact at a contact surface 271 thereof with the second hole portion 44 and the step portion 43 as shown in FIG. 4. The contact surface 271 is, on the second hole portion 44 and the step portion 43, continuous in an annular shape whose center coincides with the center axis O. The contact surface 271 and the projection area 59 overlap each other at an overlap region 272 on a front end side (lower side in FIG. 4) of the resistor 270. The overlap region 272 is located from the second hole portion 44 to the step portion 43, and is continuous in an annular shape around the center axis O on the second hole portion 44 and the step portion 43.

The conductive seal 280 includes a side-surface seal layer 281 brought into contact with the whole side surface 57 of the rear end portion 51. The side-surface seal layer 281 is in contact with the whole side surface 57 of the rear end portion 51, the step portion 43 and the resistor 270. When viewed in the axis direction, the side-surface seal layer 281 is cylindrical in shape. The thinnest part of the side-surface seal layer 281, which has the smallest thickness t1 in the axis perpendicular direction, is formed between the collar section 55 and the second hole portion 44. The thickness t1 is preferably 10 μm or larger, more preferably 100 μm or larger.

The conductive seal also includes an end-surface seal layer 282 brought into contact with the rear end surface 58 of the rear end portion 51 and the resistor 270. When viewed in the axis direction, the end-surface seal layer 282 is circular in shape. The conductive seal further includes an annular seal layer 283 brought into contact with the end-surface seal layer 282, the side-surface seal layer 281 and the resistor 270. The annular seal layer is ring-shaped when viewed in the axis direction. The thinnest part of the end-surface seal layer 282, which has the smallest thickness t2 in the axis direction, is formed at a boundary between the end-surface seal layer 282 and the annular seal layer 283. The thickness t2 is preferably 10 μm or larger, more preferably 100 μm or larger.

A manufacturing method of the spark plug 200 is different from the manufacturing method of the spark plug 10, in the process of filling the raw material powder of the conductive seal 280 into the front end region of the second hole portion 44 of the insulator 40 (i.e. the space around the rear end portion 51). In order to prevent adhesion of the raw material powder of the conductive seal 280 to the second hole portion 44, provided herein is a pipe (not shown) having an outer diameter slightly smaller than that of the second hole portion 44 and an inner diameter larger than the outer diameter of the collar section 55. This pipe is inserted into the second hole portion 44 such that a front end of the pipe abuts the step portion 43. Then, the raw material powder of the conductive seal 280 is filled into the pipe. The raw material powder of the conductive seal 280 filled in the pipe is subjected to pre-compression molding by inserting a compression rod member (not shown) into the pipe in a state of the pipe being inserted in the second hole portion 44. After the pipe and the compression rod member are taken out, the raw material powder of the resistor 270 is filled and molded.

As in the case of the first embodiment, the spark plug 200 is so configured that at least a part of the electric charge accumulated in the conductive seal 280 moves to the overlap region 272 through the cylindrical front end part of the resistor 270 at the time of spark discharge. With the passage of the electric charge through the resistor 270, there occurs a voltage drop. The energy of the electric charge can be reduced by an amount corresponding to the voltage drop. It is thus possible to prevent electrode wear. Further, it is possible to ensure impact resistance as the side-surface seal layer 281 of the conductive seal is brought into contact with the whole side surface 57 of the rear end portion 51. As the overlap region 272 is located on at least a part of the step portion 43, the length of the overlap region 272 in the axis direction can be made longer than those in the first and second embodiments. Hence the probability that the electric charge moves through the overlap region 272 and the resistor 270 at the time of spark discharge is increased to thereby more reliably prevent electrode wear.

Figure 5:
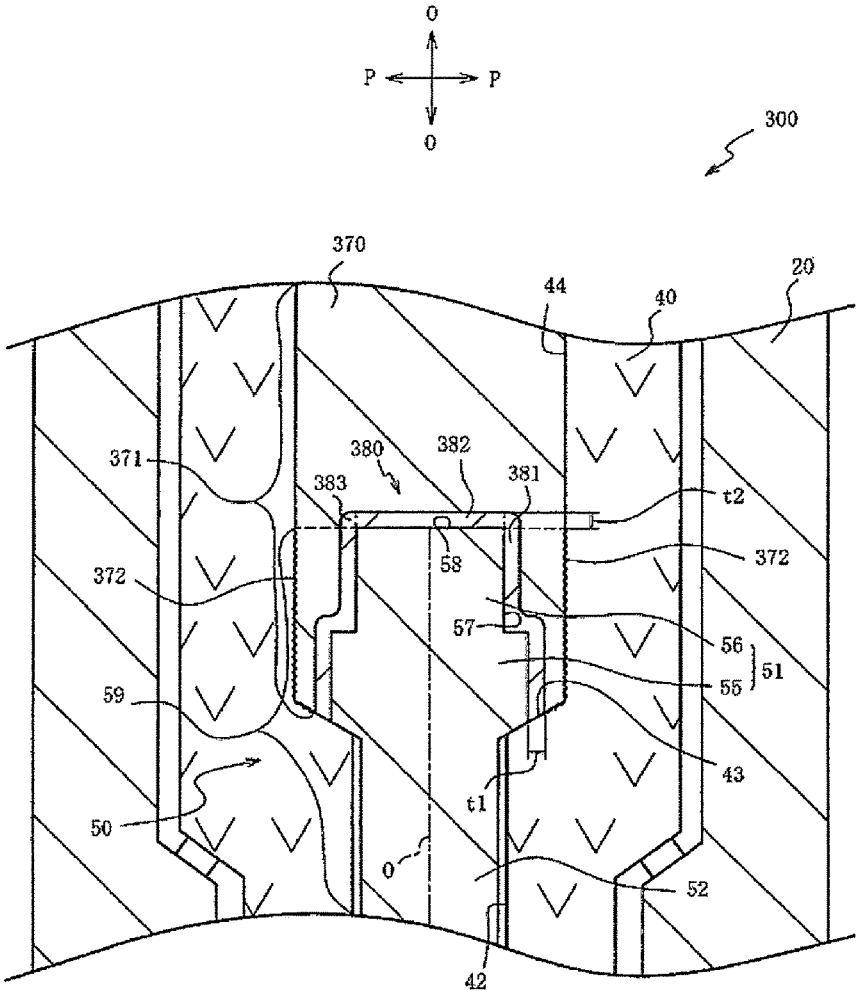
FIG. 5 is a cross-sectional view of a spark plug according to a fourth embodiment of the present invention.

The fourth embodiment will be next described below with reference to FIG. 5. The third embodiment refers to the case where the thickness of the side-surface seal layer 281 in the axis perpendicular direction on the side surface of the collar section 55 is different from that on the side surface of the head section 56. By contrast, the fourth embodiment refers to the case where a side-surface seal layer 381 of a conductive seal has substantially the same thickness in the axis perpendicular direction over the side surface 57 of the rear end portion 51 (except a boundary between the collar section 55 and the head section 56). The same parts and portions of the fourth embodiment as those of the first embodiment are designated by the same reference numerals; and explanations thereof will be omitted herefrom. FIG. 5 is a cross-sectional view of a spark plug 300 according to the fourth embodiment.

In the spark plug 300, a resistor 370 is brought into contact at a conduct surface 371 thereof with the second hole portion 44 and the step portion 43 as shown in FIG. 5. The contact surface 371 is, on the second hole portion 44 and the step portion 43, continuous in an annular shape whose center coincides with the center axis O. The contact surface 371 and the projection area 59 overlap each other at an overlap region 372 on a front end side (lower side in FIG. 5) of the resistor 370. The overlap region 372 is located from the second hole portion 44 to the step portion 43, and is continuous in an annular shape on the second hole portion 44 and the step portion 43.

The conductive seal 380 includes a side-surface seal layer 381 brought into contact with the whole side surface 57 of the rear end portion 51. The side-surface seal layer 381 is in contact with the whole side surface 57 of the rear end portion 51, the step portion 43 and the resistor 370. When viewed in the axis direction, the side-surface seal layer 381 is cylindrical in shape. The thickness t1 of the side-surface seal layer 381 in the axis perpendicular direction on the side surfaces of the collar section 55 and the head section 56 is substantially uniform over the axis direction (except a boundary between the collar section 55 and the head section 56). The thickness t1 is preferably 10 μm or larger, more preferably 100 μm or larger.

The conductive seal also includes an end-surface seal layer 382 brought into contact with the rear end surface 58 of the rear end portion 51 and the resistor 370. When viewed in the axis direction, the end-surface seal layer 381 is circular in shape. The conductive seal further includes an annular seal layer 383 brought into contact with the end-surface seal layer 382, the side-surface seal layer 381 and the resistor 370. The annular seal layer is ring-shaped when viewed in the axis direction. The thickness t2 of the end-surface seal layer 382 in the axis direction is substantially uniform over the rear end surface 58. The thickness t2 is preferably 10 μm or larger, more preferably 100 μm or larger.

A manufacturing method of the spark plug 300 is different from the manufacturing method of the spark plug 10, in the process of filling the raw material powder of the conductive seal 380 into the front end region of the second hole portion 44 of the insulator 40 (i.e. the space around the rear end portion 51). In order to prevent adhesion of the raw material powder of the conductive seal 380 to the second hole portion 44, provided herein is a pipe (not shown) having an outer diameter slightly smaller than that of the second hole portion 44 and an inner diameter larger than the outer diameter of the collar section 55. This pipe is inserted into the second hole portion 44 such that a front end of the pipe abuts the step portion 43. Then, the raw material powder of the conductive seal 380 is filled into the pipe. The raw material powder of the conductive seal 380 filled in the pipe is subjected to pre-compression molding by inserting a compression rod member (not shown), which has a flat circular front end formed with a cylindrical protruding edge, into the pipe in a state of the pipe being inserted in the second hole portion 44. After the pipe and the compression rod member are taken out, the raw material powder of the resistor 370 is filled and molded. The spark plug 300 obtains the same effects as those of the spark plug 200 of the third embodiment.

Figure 6:
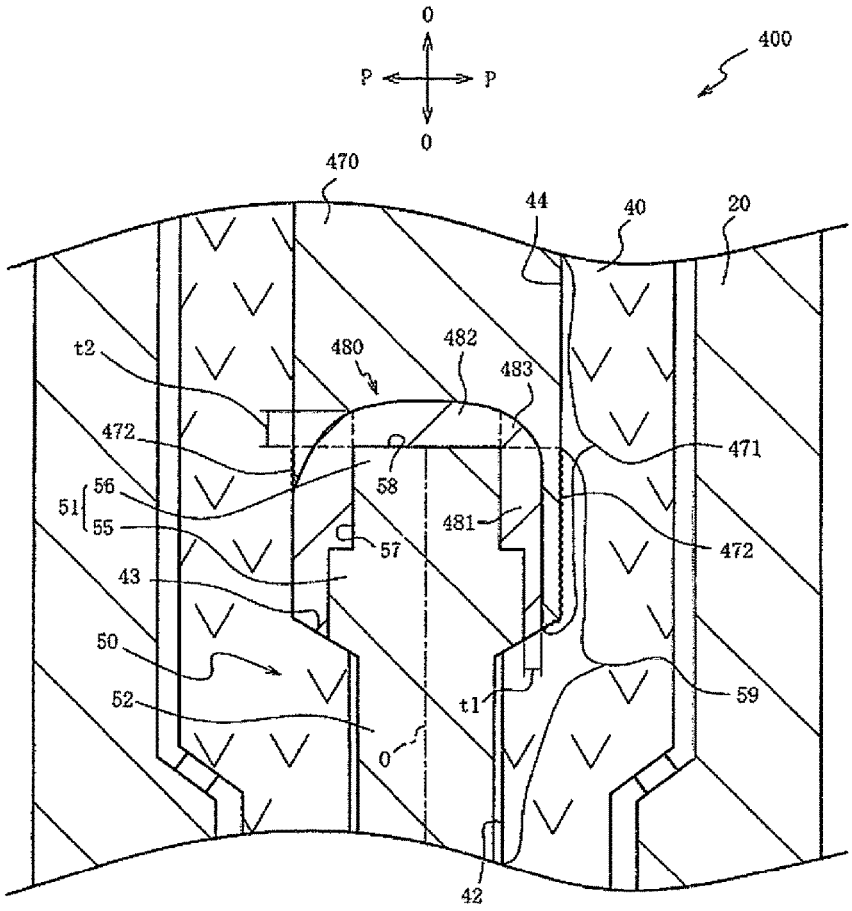
FIG. 6 is a cross-sectional view of a spark plug according to a fifth embodiment of the present invention.

The fifth embodiment will be next described below with reference to FIG. 6. FIG. 6 is a cross-sectional view of a spark plug 400 according to the fifth embodiment. The same parts and portions of the fifth embodiment as those of the first embodiment are designated by the same reference numerals; and explanations thereof will be omitted herefrom.

In the spark plug 400, a resistor 470 is brought into contact at a contact surface 471 thereof with a part of the step portion 43 and the second hole portion 44 as shown in FIG. 6. The contact surface 471 is, on the second hole portion 44, continuous in an annular shape whose center coincides with the center axis O. The contact surface 471 and the projection area 59 overlap each other at an overlap region 472 on a front end side (lower side in FIG. 6) of the resistor 470. The overlap region 472 is located from the second hole portion 44 to the part of the step portion 43, and is continuous in an annular shape on the second hole portion 44.

A conductive seal 480 includes a side-surface seal layer 481 brought into contact with the whole side surface 57 of the rear end portion 51. The side-surface seal layer 481 is in contact with the whole side surface 57 of the rear end portion 51, the part of the step portion 43 and the resistor 470. When viewed in the axis direction, the side-surface seal layer 481 is cylindrical in shape. The thinnest part of the side-surface seal layer 481, which has the smallest thickness t1 in the axis perpendicular direction, is formed between the collar section 55 and the second hole portion 44. The thickness t1 is preferably 10 μm or larger, more preferably 100 μm or larger.

The conductive seal also includes: an end-surface seal layer 482 brought into contact with the rear end surface 58 of the rear end portion 51 and the resistor 470; and an annular seal layer 483 brought into contact with the end-surface seal layer 482, the side-surface seal layer 481 and the resistor 470. The thickness t2 of the end-surface seal layer 482 in the axis direction at a boundary between the end-surface seal layer 482 and the annular seal layer 483 (i.e. the thinnest part) is preferably 10 μm or larger, more preferably 100 μm or larger.

A manufacturing method of the spark plug 400 is different from the manufacturing method of the spark plug 10, in the process of filling the raw material powder of the conductive seal 480 into the front end region of the second hole portion 44 of the insulator 40 (i.e. the space around the rear end portion 51). In order to prevent adhesion of the raw material powder of the conductive seal 480 to the second hole portion 44, provided herein is a pipe (not shown) having on a front end thereof an arc cross-section protrusion of slightly smaller outer diameter than that of the second hole portion 44 and larger inner diameter than the outer diameter of the collar section 55. This pipe is inserted into the second hole portion 44 such that the protrusion on the front end of the pipe abuts the step portion 43. Then, the raw material powder of the conductive seal 480 is filled into the pipe. The raw material powder of the conductive seal 480 filled in the pipe is subjected to pre-compression molding by inserting a compression rod member (not shown), which a concave end surface curved inwards in the middle, into the pipe in a state of the pipe being inserted in the second hole portion 44. After the pipe and the compression rod member are taken out, the raw material powder of the resistor 470 is filled and molded. As the overlap region 472 is located from the second hole portion 44 to the part of the step portion 43, the spark plug 400 obtains the same effects as those of the spark plug 200 of the third embodiment.

Figure 7:
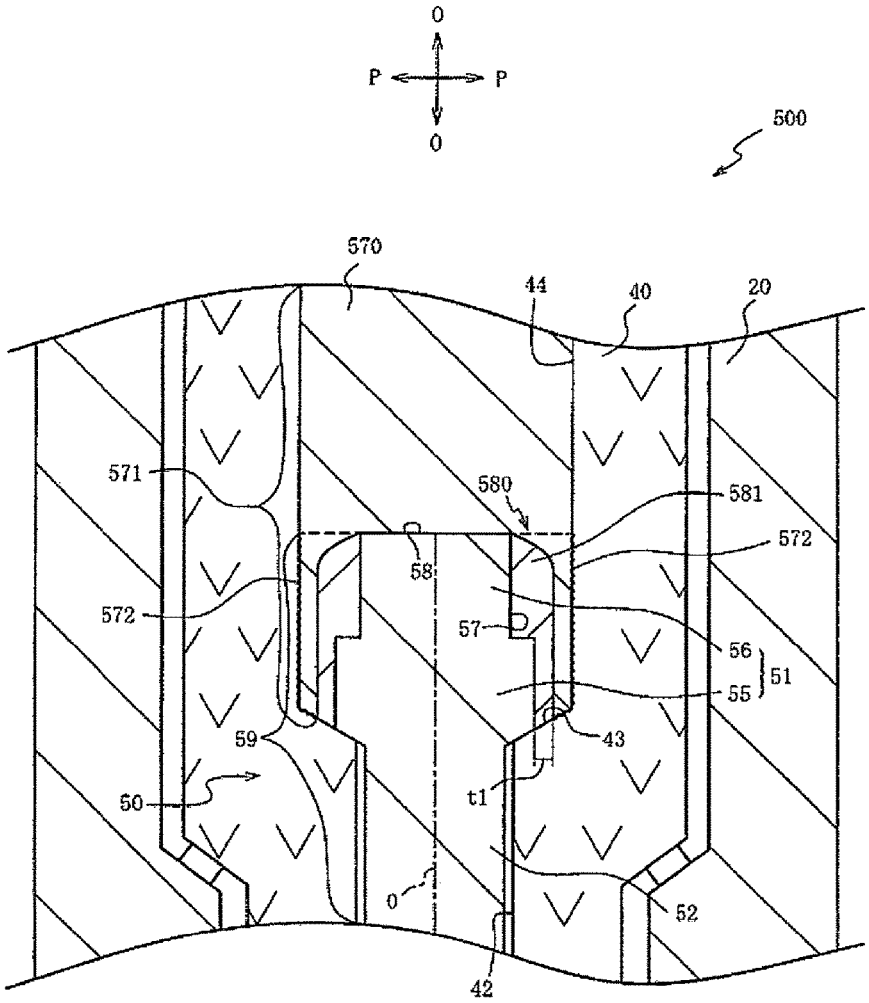
FIG. 7 is a cross-sectional view of a spark plug according to a sixth embodiment of the present invention.

The sixth embodiment will be next described below with reference to FIG. 7. FIG. 7 is a cross-sectional view of a spark plug 500 according to the sixth embodiment. The same parts and portions of the sixth embodiment as those of the first embodiment are designated by the same reference numerals; and explanations thereof will be omitted herefrom.

In the spark plug 500, a resistor 570 is brought into contact at a contact surface thereof 571 with the step portion 43 and the second hole portion 44 as shown in FIG. 7. The contact surface 571 is, on the step portion 43 and the second hole portion 44, continuous in an annular shape whose center coincides with the center axis 0. The contact surface 571 and the projection area 59 overlap each other at an overlap region 572 on a front end side (lower side in FIG. 7) of the resistor 570. The overlap region 572 is located from the second hole portion 44 to the step portion 43, and is continuous in an annular shape on the step portion 43 and the second hole portion 44.

A conductive seal 580 includes a side-surface seal layer 581 brought into contact with the whole side surface 57 of the rear end portion 51. The side-surface seal layer 581 is in contact with the whole side surface 57 of the rear end portion 51, the step portion 43 and the resistor 570. When viewed in the axis direction, the side-surface seal layer 581 is cylindrical in shape. The thinnest part of the side-surface seal layer 581, which has the smallest thickness t1 in the axis perpendicular direction, is formed between the collar section 55 and the second hole portion 44. The thickness t1 is preferably 10 μm or larger, more preferably 10 μm or larger.

A manufacturing method of the spark plug 500 is different from the manufacturing method of the spark plug 10, in the process of filling the raw material powder of the conductive seal 580 into the front end region of the second hole portion 44 of the insulator 40 (i.e. the space around the rear end portion 51). In order to prevent adhesion of the raw material powder of the conductive seal 580 to the second hole portion 44, provided herein is a first pipe (not shown) having an outer diameter slightly smaller than that of the second hole portion 44 and an inner diameter larger than the outer diameter of the head section 56. The first pipe is inserted into the second hole portion 44 such that a protrusion on a front end of the first pipe abuts the step portion 43. Similarly, a second pipe (not shown) having an inner diameter slightly larger than the outer diameter of the head section 56 is herein provided in order to prevent adhesion of the raw material powder of the conductive seal 580 to the rear end surface 58. The second pipe is inserted into the first pipe such that a front end of the second pipe covers the head section 56.

Then, the raw material powder of the conductive seal 580 is filled in a space between the first pipe and the second pipe. The raw material powder of the conductive seal 580 filled between the first and second pipes is subjected to pre-compression molding by inserting a compression cylindrical member (not shown) between the first and second pipes in a state of the first and second pipes being inserted in the second hole portion 44. After the first and second pipes are taken out, the raw material powder of the resistor 570 is filled and molded. As the overlap region 572 is located from the second hole portion 44 to the step portion 43, the spark plug 500 obtains the same effects as those of the spark plug 200 of the third embodiment.

Figure 8:
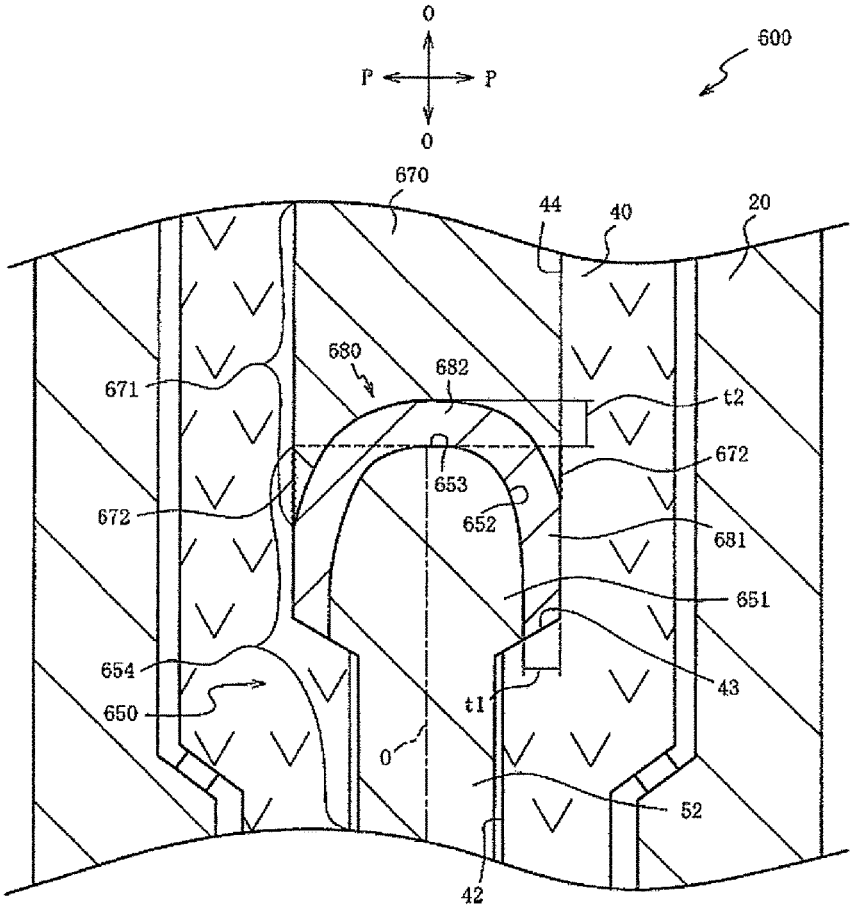
FIG. 8 is a cross-sectional view of a spark plug according to a seventh embodiment of the present invention.

The seventh embodiment will be next described below with reference to FIG. 8. The first to sixth embodiments each refer to the case where the rear end portion 51 of the center electrode 50 is formed in a cylindrical column shape with the collar section 55 and the head portion 56 and is arranged in the axial hole 41. By contrast, the seventh embodiment refers to the case where a center electrode 650 has a rear end portion 651 formed in a dome shape and arranged in the axial hole 41. The same parts and portions of the seventh embodiment as those of the first embodiment are designated by the same reference numerals; and explanations thereof will be omitted herefrom. FIG. 8 is a cross-sectional view of a spark plug 600 according to the seventh embodiment.

As shown in FIG. 8, the rear end portion 651 of the center electrode 650 has an axially symmetrical dome shape whose center coincides with the center axis O. A part (top) of an outer surface of the rear end portion 651 intersecting the center axis O corresponds to a rear end surface 653; and any outer surface of the rear end portion other than the rear end surface 653 corresponds to a side surface 652. The side surface 652 of the rear end portion 651 has an outer diameter gradually decreasing from the front end side (lower side in FIG. 8) toward the rear end surface 653 along the direction of the center axis O. In the rear end portion 651, the maximum outer diameter of the side surface 652 is made larger than the outer diameter of the leg portion 52 and larger than the inner diameter of the first hole portion 42. Consequently, the rear end portion 651 is disposed on the step portion 43 and situated in the second hole portion 44.

A resistor 670 is brought into contact at a contact surface 671 thereof with the second hole portion 44 of the insulator 40. The contact surface 671 is, on the second hole portion 44, continuous in an annular shape whose center coincides with the center axis O. It is herein assumed that a projection area 654 is defined by projecting the center electrode 650 in the axis perpendicular direction around the center axis O. The contact surface 671 and the projection area 654 overlap each other at an overlap region 672 on a front end side (lower side in FIG. 8) of the resistor 670. The overlap region 672 is continuous in an annular shape on the second hole portion 44.

A conductive seal 680 includes: a side-surface seal layer 681 brought into contact with the whole side surface 652 of the rear end portion 651; and an end-surface seal layer 682 brought into contact with the whole rear end surface 653 of the rear end portion 651. The side-surface seal layer 681 is in contact with the whole side surface 652, the second hole portion 44, the step portion 43 and the resistor 670. The thickness t1 of the thinnest part of the side-surface seal layer 681 in the axis perpendicular direction is preferably 10 μm or larger, more preferably 100 μm or larger. The end-surface seal layer 682 is in contact with the rear end surface 653 of the rear end portion 651 and the resistor 70. The thickness t2 of the end-surface seal layer 682 at the center axis O is preferably 10 μm or larger, more preferably 100 μm or larger.

As a manufacturing method of the spark plug 600 is similar to the manufacturing method of the spark plug 10 of the first embodiment, an explanation of the manufacturing method will be omitted herefrom. The spark plug 600 obtains the same effects as those of the first embodiment.

EXAMPLES

Spark plugs of Experimental Examples 1 to 7 were prepared, each having the same structure as the spark plug 300 shown in FIG. 5. The spark plugs of Experimental Examples 1 to 7 were common with each other in that the side-surface seal layer 381 was entirely in contact with the whole side surface 57 of the rear end portion 51, but were different from each other in that the thickness t1 of the side-surface seal layer 381 in the axis perpendicular direction was varied within the range of 0.1 μm to 150 μm.

<Impact Resistance Test>

Impact test was performed on the spark plugs of Experimental Examples 1 to 7 in compliance with Section 7.4 of JIS B8031 (2006). More specifically, each of the spark plugs of Experimental Examples 1 to 7, eight samples for each example, was set to a test machine and subjected to impact at a rate of 400 times per minute for 10 minutes. After that, the occurrence of an anomaly (loosening of the center electrode 50) in each of the eight samples was examined. In each experimental example, the test was stopped upon detection of an anomaly in any one of the samples. When there occurred no anomaly in all of the eight samples, these samples were further subjected to impact for every 10 minutes, 100 minutes maximum. Herein, the impact amplitude was 22 mm. The spark plug was judged as: "◎" when there was no anomaly even after 100 minutes; "○" when no anomaly occurred for 50 minutes or more; and "×" when an anomaly occurred for less than 20 minutes.

The relationship of the thickness t1 (μm) of the side-surface seal layer 381 and the test results of the spark plugs of Experimental Examples 1 to 7 are shown in TABLE 1.

TABLE 1

| | Thickness | Test time (min) | | | | | | | | | | |
|---|---|---|---|---|---|---|---|---|---|---|---|---|
| | (μm) | 10 | 20 | 30 | 40 | 50 | 60 | 70 | 80 | 90 | 100 | Evaluation |
| Experimental Example 1 | 0.1 | NG | — | — | — | — | — | — | — | — | — | X |
| Experimental Example 2 | 1 | NG | — | — | — | — | — | — | — | — | — | X |
| Experimental Example 3 | 10 | OK | OK | OK | OK | OK | NG | — | — | — | — | ○ |
| Experimental Example 4 | 50 | OK | OK | OK | OK | OK | OK | OK | NG | — | — | ○ |
| Experimental Example 5 | 80 | OK | OK | OK | OK | OK | OK | OK | OK | NG | — | ○ |
| Experimental Example 6 | 100 | OK | OK | OK | OK | OK | OK | OK | OK | OK | OK | ◎ |
| Experimental Example 7 | 150 | OK | OK | OK | OK | OK | OK | OK | OK | OK | OK | ◎ |

As shown in TABLE 1, there occurred no anomaly for 50 minutes or more when the thickness t1 of the side-surface seal layer 381 in the axis perpendicular direction was larger than or equal to 10 μm (Experimental Examples 3 to 7). In particular, there was no anomaly even after 100 minutes when the thickness t1 of the side-surface seal layer 381 in the axis perpendicular direction was larger than or equal to 100 μm (Experimental Examples 6 and 7). In the spark plugs of Experimental Examples 3 to 7, a change in the resistance before and after the test was in the range of ±10% of the resistance value before the test. It has been shown by these experimental examples that it is possible to secure the impact resistance of the spark plug by controlling the thickness of the side-surface seal layer in the axis perpendicular direction on the whole side surface of the rear end portion of the center electrode to be 10 μm or larger, preferably 100 μm or larger.

Although the present invention has been described with reference to the above specific embodiments and working examples, the present invention is not limited to the above embodiments and working examples. It is easily understood that various changes and modifications of the embodiments and working examples can be made without departing from the scope of the present invention. For example, the above-mentioned shapes and dimensions of the metal shell 20, the insulator 40, the center electrode 50 and the terminal electrode 60 and the above-mentioned shape and number of the ground electrode 30 are merely examples and can be set as appropriate. Needless to say, the shape of the rear end portion 51, 651 can also be set as appropriate.

In each of the above embodiments, the electrode tips 32 and 54 are respectively joined to the ground electrode 30 and the center electrode 50. The present invention is however not necessarily limited to such a configuration. As a matter of course, it is feasible to omit the electrode tip 32, 54.

In the second to seventh embodiments, the over region 172, 272, 372, 472, 572, 672 is continuous in an annular shape on the second hole portion 44 (that is, the overlap region includes the whole edge of the projection area 59). The overlap region is however not necessarily limited to such a continuous annular shape. As explained in the first embodiment, it is a matter of course that the overlap region 172, 272, 372, 472, 572, 672 can be located to include a part or the whole of the edge of the projection area 59.

In the seventh embodiment, the contact surface 671 of the resistor 670 is provided on the second hole portion 44. It is a matter of course that the contact surface 671 of the resistor 670 can be provided from the second hole portion 44 to the step portion 43 as explained in the third to fifth embodiments. In such a case, the overlap region 672 is located from the second hole portion 44 to at least a part of the step portion 43 so that the length of the overlap region 672 in the axis direction can be made longer. The probability that the electric charge moves through the overlap region 672 and the resistor 670 at the time of spark discharge is increased to thereby more reliably prevent electrode wear.

DESCRIPTION OF REFERENCE NUMERALS

10, 100, 200, 300, 400, 500, 600: Spark plug
20: Metal shell
30: Ground electrode
40: Insulator
41: Axial hole
42: First hole portion
43: Step portion
44: Second hole portion
50, 650: Center electrode
51, 651: Rear end portion
52: Leg portion
57, 652: Side surface
58, 653: Rear end surface
59: Projection area
60: Metal terminal
70, 170, 270, 370, 470, 570, 670: Resistor
71, 171, 271, 371, 471, 571, 671: Contact surface
72, 172, 272, 372, 472, 572, 672: Overlap region (Overlap)
80, 180, 280, 380, 480, 580, 680: Conductive seal
81, 181, 281, 381, 481, 581, 681: Side-surface seal layer
82, 282, 382, 482, 682: End-surface seal layer
O: Center axis
t1, t2: Thickness Having described the invention, the following is claimed:

1. A spark plug, comprising:

a cylindrical metal shell having a front end to which a ground electrode is joined;

an insulator formed with an axial hole and having an outer circumferential surface partially surrounded by the metal shell, the axial hole including a first hole portion and a second hole portion larger in inner diameter than the first hole portion and continuous to the first hole portion via a step portion;

a center electrode having a rear end portion disposed on the step portion of the insulator and a leg portion extending from the rear end portion toward the ground electrode in an axis direction;

a metal terminal having a front end portion disposed in the second hole portion with a space left between the front end portion of the metal terminal and the rear end portion of the center electrode;

a resistor arranged between the front end portion of the metal terminal and the rear end portion of the center electrode within the second hole portion; and a conductive seal brought into contact with the resistor and the rear end portion of the center electrode, wherein the conductive seal comprises a side-surface seal layer being in contact with the whole of a side surface of the rear end portion and having a thickness of 10 μm or larger in a direction perpendicular to the axis direction; and wherein, assuming that a projection area is defined by projecting the center electrode onto the axial hole in the direction perpendicular to the axis direction around a center axis of the spark plug, a contact surface of the resistor brought into contact with the axial hole overlaps at least a part of the projection area.

2. The spark plug according to claim 1, wherein the thickness of the side-surface seal layer is 100 μm or larger.

3. The spark plug according to claim 1, wherein an overlap of the contact surface and the projection area is continuous in an annular shape on the axial hole.

4. The spark plug according to claim 1, wherein the overlap of the contact surface and the projection area is located on at least a part of the step portion.

5. The spark plug according to claim 1, wherein the conductive seal comprises an end-surface seal layer being in contact with the whole of an end surface of the rear end portion in the axis direction and having a thickness of 10 μm or larger.

* * * * *